US006474829B2

(12) United States Patent
Clodfelter

(10) Patent No.: US 6,474,829 B2
(45) Date of Patent: Nov. 5, 2002

(54) OUTLET MOUNTED LIGHT FIXTURE

(76) Inventor: James F. Clodfelter, 1007 Pickett Pl. SW., Vienna, VA (US) 22180

( * ) Notice: Subject to any disclaimer, the term of this patent is extended or adjusted under 35 U.S.C. 154(b) by 3 days.

(21) Appl. No.: 09/725,113

(22) Filed: Nov. 29, 2000

(65) Prior Publication Data

US 2002/0064039 A1 May 30, 2002

(51) Int. Cl.[7] ..... F21V 33/00

(52) U.S. Cl. ..... 362/95; 362/233; 362/198; 362/234; 362/250

(58) Field of Search ..... 362/95, 234, 250, 362/413, 238, 239, 233, 198, 419; 439/105, 620 R

(56) References Cited

U.S. PATENT DOCUMENTS

| | | | | | |
|---|---|---|---|---|---|
| 375,702 | A | * | 12/1887 | Fasoldt | 362/233 |
| 2,343,009 | A | * | 2/1944 | Hall | 362/233 |
| 3,924,914 | A | * | 12/1975 | Banner | 339/14 |
| 4,000,405 | A | * | 12/1976 | Horwinski | 240/2 |
| 4,106,081 | A | | 8/1978 | Turturici | 362/361 |
| 4,931,911 | A | * | 6/1990 | Hanson | 362/95 |
| 5,142,457 | A | | 8/1992 | Wehner | 362/70 |
| 5,453,899 | A | * | 9/1995 | Page | 361/1 |
| 5,486,987 | A | | 1/1996 | Fritz, Jr. | 362/226 |
| 5,562,341 | A | | 10/1996 | Strauss | 362/226 |
| 5,601,360 | A | | 2/1997 | Paquette | 362/226 |
| 5,774,317 | A | * | 6/1998 | Allina | 361/56 |

* cited by examiner

*Primary Examiner*—Sandra O'Shea
*Assistant Examiner*—Anabel Ton
(74) *Attorney, Agent, or Firm*—Jacobson Holman PLLC

(57) ABSTRACT

An outlet mounted light fixture adapted to overlie and completely cover an existing wall outlet. The outlet fixture includes a flat front panel and a flat back panel parallel to the flat front panel. There are a plurality of prongs extending from the back panel for entering and electrically connecting to the existing wall outlet. The cover is designed for visual pleasure and is relatively strong to support electrical outlets mounted on the flat front panel to receive electrical conductors. The fixture also has side electrical outlets mounted on either side panel. The fixture adds one or more hollow elongated stems which extend from the top panel. These stems or poles can be rigid or flexible. The stems receive the light bulbs and have the wiring and on/off switch connecting the bulbs to the outlet. The fixture can be placed in any outlet and the lights can illuminate an area for reading or for generally lighting the area. The fixture eliminates the need for a free standing light and the attached power cord.

15 Claims, 3 Drawing Sheets

OUTLET MOUNTED LIGHT FIXTURE

BACKGROUND OF THE INVENTION

1. Field of the Invention

The present invention pertains generally to electrical outlet adaptors and, more specifically, to an electrical outlet adaptor with a mounted light fixture.

2. Description of the Prior Art

Electrical devices such as light fixtures are commonly mounted on interior or exterior surfaces with what is known in the electrical trade as an outlet box. Outlet boxes are adapted to receive electrical cables and outlet covers. They are typically mounted either flush with or recessed within a wall, ceiling or floor.

The patent art discloses various lights and electrical adapters. U.S. Pat. No. 4,000,405 to Horwinski discloses an electrical adapter and night light. The Horwinski wall plate has a configuration of a truncated pyramid with four sloping faces and a top plateau portion wherein the plate is adapted to overlie and completely conceal the wall outlet. The patent discloses a pair of night lights which are built into the adapter and are for illuminating a small area during the night. According to the patent, the adapter includes a switch to control the lighting. The night light of the Horwinski patent also includes a pair of outlets which can facilitate the use of the wall plate outlets which it covers. There is no extendable stem nor does the patent suggest using the lighting for anything other than a dim night light.

U.S. Pat. No. 5,142,457 to Wehner and U.S. Pat. No. 5,486,987 to Fritz, Jr. are directed to boat lighting. The lights of each of the patents are on an extendable or movable stem to direct the lighting. Neither patent suggests that the devices have outlets attached thereto.

The problem in the prior art is that the light fixtures all need a power cord to place them near a suitable area to illuminate, such as a reading area or viewing area. Also, the concept of night lights only illuminate small areas. The present invention eliminates the need for a power cord in that the light or illumination means extends from the outlet and can be positioned in any suitable spot to illuminate the area. Thus, this invention eliminates the need for free standing lamps and power cords.

SUMMARY OF THE INVENTION

The present invention seeks to solve the problems with the prior art and offers an outlet mounted light fixture adapted to overlie and completely cover an existing wall outlet. The outlet mounted light fixture is a wall plate having a configuration of a truncated pyramid with four sloping faces and a top plateau portion. The outlet mounted light fixture has a back part or panel that is formed to be adapted to overlie and to completely conceal an existing wall outlet. On the flat front panel there are outlets which are three prong outlets, so that the covered existing outlet can still be used through the fixture to receive plugs to provide power to other appliances, lights or other electrical devices.

Additionally, the flat front panel includes a connecting screw for mounting the flat front panel to the existing wall outlet. This screw is elongated for extending through the fixture and to the underlying existing wall outlet. Once the screw is in place the fixture is securely mounted. Because of the tight fit and the complete overlie on the existing outlet the fixture is supported not only by the screw, but also by the top of the fixture overhanging on the top of the existing wall outlet.

The top panel has a stem or stems which are hollow poles extended therefrom. The elongated hollow poles can be rigid, partially flexible or completely flexible and bendable. The poles carry and protect an on/off switch and the electrical wiring. The poles extend at a sufficient height so that the area can be illuminated. At the top of the poles are connected a bulb or bulbs. The bulbs fit into an electrical receptacle which is electrically connected to the outlets by way of the electrical wiring. Of course, halogen bulbs could be used and each of the bulbs can include a shade or a decorative cover. The bulbs are removable and replaceable.

It is therefore an object of the present invention to provide an outlet mounted light fixture adapted to overlie and completely cover an existing wall outlet.

It is another object of the invention to provide a flat front panel, a flat back panel parallel to the flat front panel and a plurality of prongs extending from the back panel for entering and electrically connecting to an existing wall outlet.

Another object of the invention is to provide a top panel connected to the flat front panel and the flat back panel with a bottom panel connected to the flat front panel and the flat back panel, and a right side panel and a left side panel, with each of the side panels connecting the top panel and the bottom panel to complete part of the outlet wall light fixture.

A further object of the present invention is to provide at least one electrical outlet mounted on the flat front panel for receiving electrical conductors and electrically connected to the plurality of prongs.

A still further object of the invention is to provide at least one side electrical outlet mounted on either side panel for receiving electrical conductors and electrically connected to the plurality of prongs.

It is an object of the present invention to provide at least one light means electrically connected to the at least one electrical outlet and electrically connected to the plurality of prongs, for providing illumination to a selected area.

A further object of the present invention is to provide at least one stem for physically connecting the light means to the top panel and extending above the top panel for positioning the light means in the selected areas for illumination.

Another object of the invention is to provide receptacle means positioned in the at least one stem for electrically connecting the at least one outlet to the at least one light means and to the plurality of prongs for electrically receiving power.

A still further object of the present invention is to provide the stems as either a rigid hollow structure or as a flexible hollow structure for receiving electrical wiring, the wiring extending from the at least one light means and at least one electrical outlet.

It is an object of the invention to provide mounting means for securely mounting the outlet mounted light fixture to the existing wall outlet, and the mounting means providing support to said fixture.

It is an object of the invention to provide an elongated screw for extending from the flat front panel through the fixture and into the existing wall outlet and the elongated screw being removable.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

A preferred apparatus of this invention is disclosed in the accompanying drawings in which.

DESCRIPTION OF THE INVENTION

Figure 1:
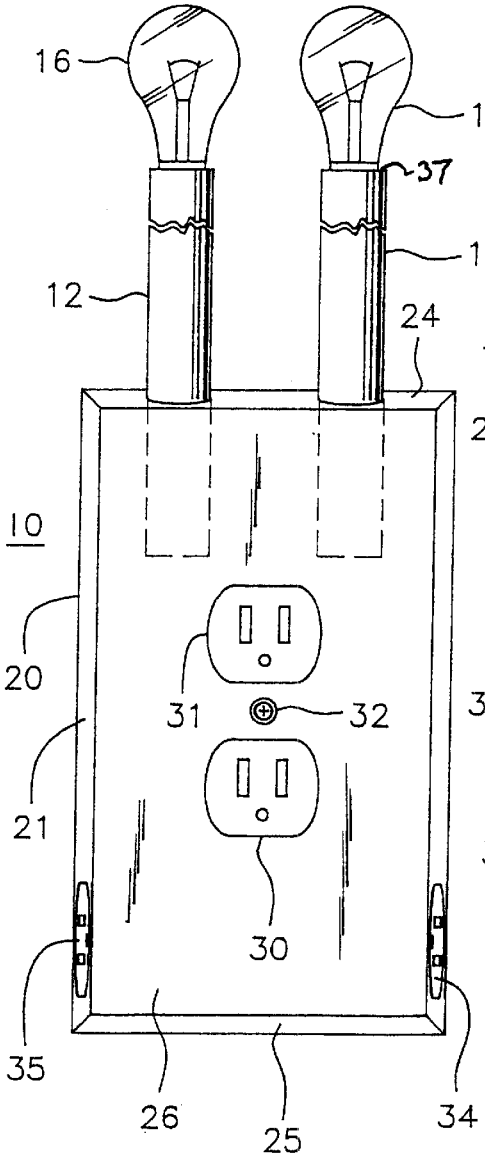
FIG. 1 illustrates a front view of an outlet mounted light fixture having two illumination means mounted thereon according to a first embodiment of the invention.

Although only a few preferred embodiments of the invention are explained in detail, it is to be understood that the embodiments are given by way of illustration only. It is not intended that the invention is to be limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

Figure 2:
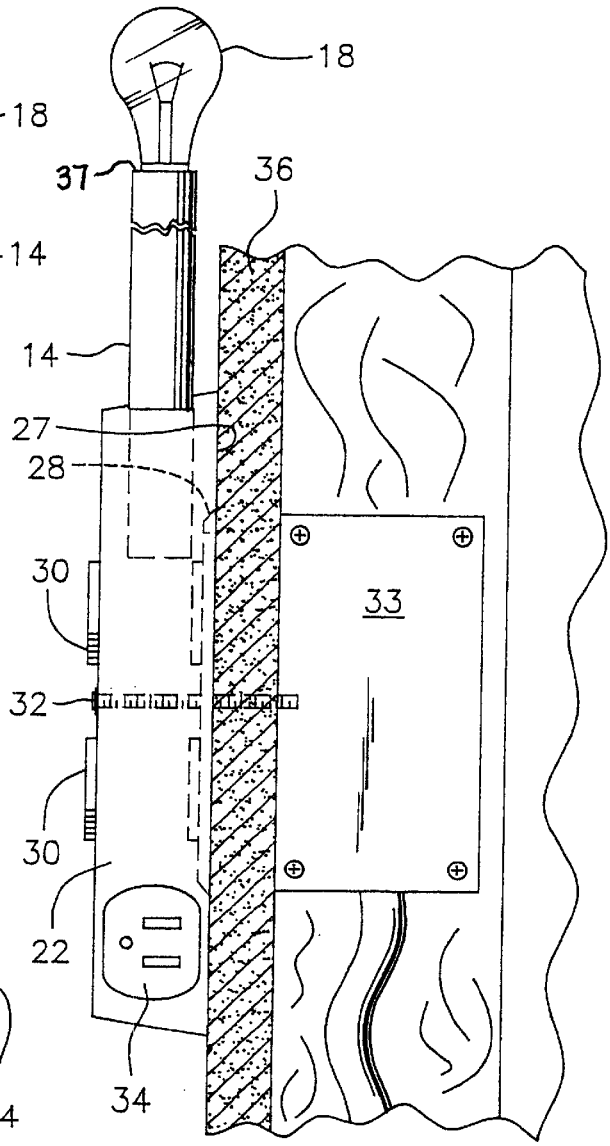
FIG. 2 illustrates a side view of the present invention mounted to a wall and outlet box according to the invention.

With reference to FIGS. 1 and 2, the present invention of an outlet mounted light fixture is shown and the fixture is generally indicated by reference numeral 10. As can be seen in the Figures, the fixture 10 includes two stem poles 12, 14 and lights 16, 18. FIG. 1 shows an outlet portion 20 as a wall plate having a configuration of a truncated pyramid with four sloping faces. There are two side portions 21, 22, a top portion 24 and a bottom portion 25. Also, the plate 20 includes a top plateau portion or flat front panel 26. The plate 20 is adapted to overlie and to completely conceal a wall outlet 28 which is shown in dotted lines in FIG. 2.

On the flat front panel 26, there are two electrical outlets 30, 31 which are three prong outlets. It is possible that four outlets could be utilized but in the preferred invention, only two are shown on the flat front panel 26. Also, it is possible not to have any outlets on the fixture. Because one may not want to overload a circuit or may want to dedicate the outlet only for the light fixture.

Additionally, the flat front panel 26 includes a connecting screw 32 for mounting the flat front panel 26 to the wall outlet 28 and for extending through the wall outlet 28 to an underlying outlet box 33. The bottom portion or panel 25 extends from the top flat front panel 26 and connects the top front panel 26 to a flat back panel 27. The side portions or side panels 21, 22 are sloping to the flat front panel 26. The side panels have outlets 34, 35 on either side. The outlets 34, 35 can be reached by the user without too much trouble, because of the sloping sides. Of course, the fixture 10 could include only one side outlet or for that matter no side outlets.

The top portion or panel 24 attaches to both side panels 21, 22 and flat front panel 26. From the top panel 24 extends, as shown in the figures, the two stems or poles 12, 14 which protect and carry the electrical wiring. The poles 12, 14 extend at a sufficient height so that an area can be illuminated for reading. In this embodiment, the poles 12, 14 are rigid. At the top of each pole 12, 14 is an electrical receptacle 37 and on/off switch (not shown) connected to a light or bulb 16, 18. In this case, since there are two stems 12, 14, there are two bulbs 16, 18. Of course, halogen bulbs could be used and each of the bulbs 16, 18 can include a shade or a decorative cover. Additionally, the bulbs 16, 18 are removable and replaceable.

Directing attention to FIG. 2, illustrated is the present invention mounted to a wall 36 and covering the outlet box 33. The figure illustrates the screw 32 extending from the flat front panel through the outlet mounted light fixture 10 into the cover plate of the wall outlet 28 and attaching onto the outlet box 33. This screw 32 provides the tight and secure attachment of the outlet mounted light fixture 10 to the wall 36. Additionally, as shown in FIG. 2, the back panel 27 of fixture 10 is fitted such that it has a curved portion type form so that it will clamp or tightly fit to the cover plate 28 of the wall outlet and prevent sliding. It also absorbs some of the pressure of the weight of the light poles 12, 14 and securely mounts the outlet mounted light fixture 10 to the wall 36.

Figure 3:
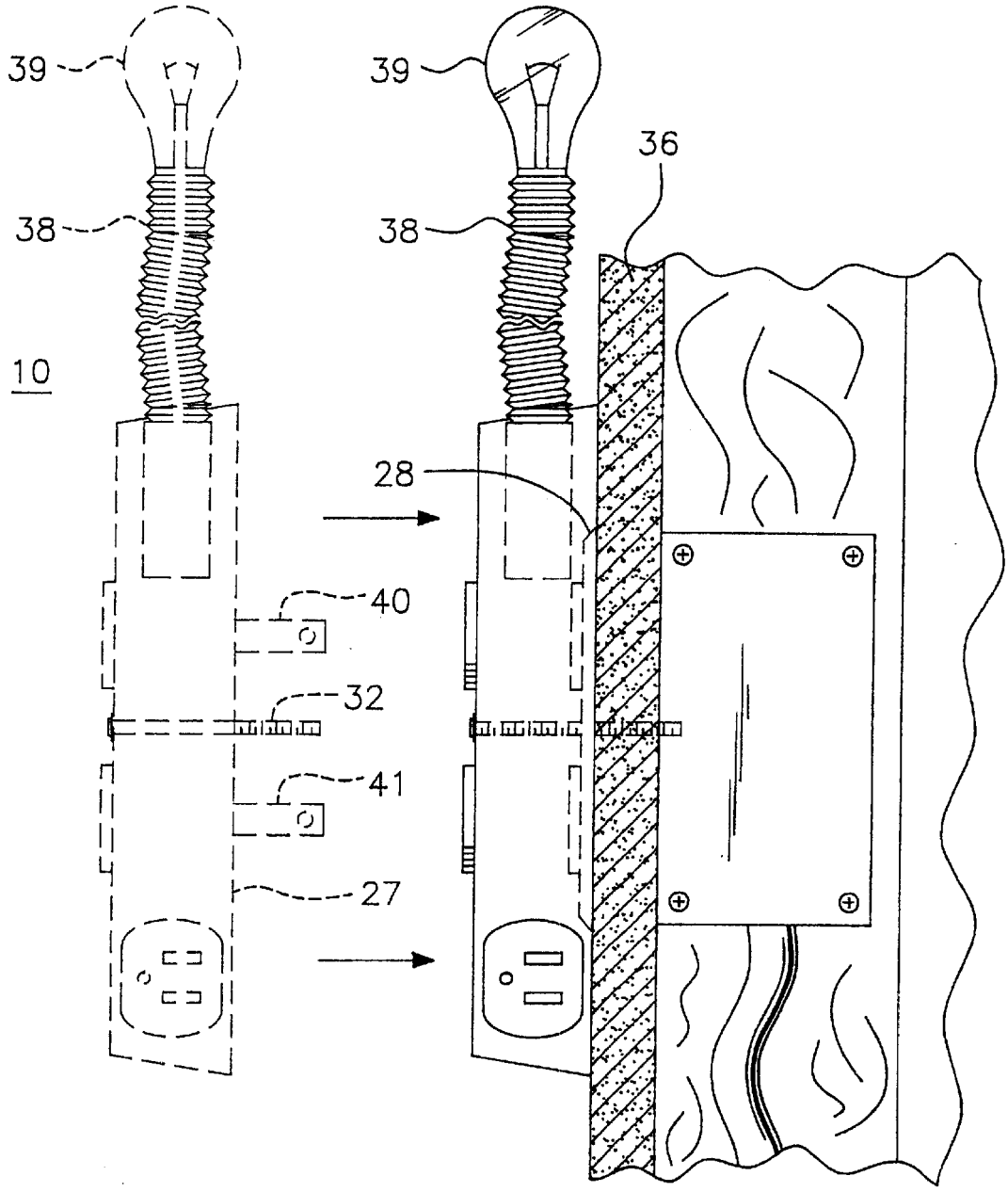
FIG. 3 illustrates a second embodiment of the invention according to the invention.

With reference now to FIG. 3, the figure shows a further embodiment of the present invention. In this figure, the outlet mounted light fixture 10 includes a flexible and bendable pole or stem 38 extending from the top panel. The flexible pole includes an illumination or a light bulb 39 attached thereto. The purpose or function of the flexible pole 38 is to be bendable into a position for reading or to position the light 39 to illuminate a specific area. The flexible pole 38 is shown with the entire part of it being bendable or flexible. It has been contemplated that either all of the pole is bendable or just a portion thereof is bendable and this is well within the scope of the present invention.

With the flexible pole 38, the user can position a chair near the wall outlet 28 and electrically connect the fixture 10. The light 39 goes on and illuminates the area for reading. There is no need for a power cord.

Additionally, the fixture 10 is of great advantage in the bedroom as a reading light without the use of a night stand, thus, eliminating either the need for a night stand or alternatively freeing space on the night stand near the bed. The screw 32 is shown which can have sufficient length so as to be receivable in the threaded recess of the wall outlet, thereby, providing a permanent retention for the outlet mounted light fixture and eliminating the possibility of its being jarred or becoming loose.

In FIG. 3, the outlet mounted light fixture 10 is shown in dotted lines as it is separated from the wall 36 and cover plate 28 so as to illustrate prongs 40, 41 extending therefrom. The fixture 10 includes a pair of conductor prongs 40, 41 protruding from the flat back panel 27 of the fixture and adapted to be received in the openings of the wall outlet for establishing electrical contact with the circuits thereof.

Figure 4:
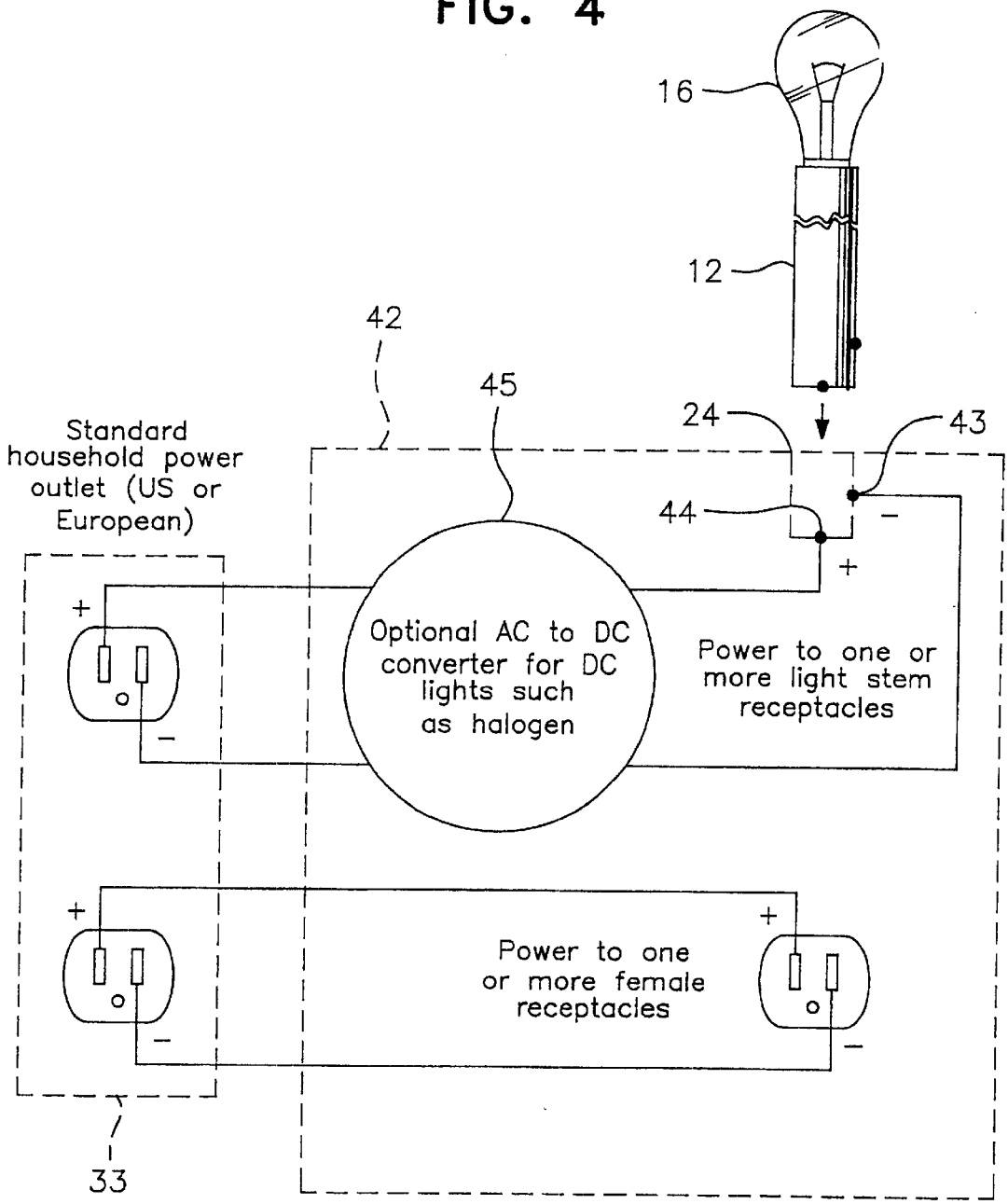
FIG. 4 illustrates a circuit diagram according to the present invention.

As illustrated in FIG. 4, the circuitry 42 of the outlet mounted light fixture 10 is shown. The pole 12 is inserted in the top panel 24 and includes two connections, one for ground 43 and the other for positive flow of electricity 44. Each of the connections are made to other respective plus or minus leads such that the wall outlet box 33 nearly becomes an extension through the outlet mounted light fixture 10. Of course, optionally, an AC to DC converter 45 for DC lights such as halogen could be implemented in the circuitry of the fixture 10.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. An outlet mounted light fixture adapted to overlie and completely cover an existing wall outlet, comprising:

a flat front panel;

a flat back panel parallel to said flat front panel;

a plurality of prongs extending from said back panel for entering and electrically connecting to said existing wall outlet;

a top panel connected to said flat front panel and said flat back panel;

a bottom panel connected to said flat front panel and said flat back panel;

a right side panel and a left side panel, each said side panels connecting said top panel and said bottom panel;

at least one light electrically connected to said plurality of prongs, for providing illumination to a selected area;

at least one stem for physically connecting said light to said top panel and extending above said top panel for positioning said light in said selected areas for illumination;

receptacle means positioned in said at least one stem for electrically connecting to said at least one light and to said plurality of prongs for electrically receiving power; and said at least one stem including a bendable and flexible hollow structure for receiving electrical wiring, said wiring extending from said at least one light and said plurality of prongs.

2. The outlet mounted light fixture adapted to overlie and completely cover an existing wall outlet, as recited in claim 1, wherein said at least one stem comprising:

a rigid hollow structure for receiving electrical wiring, said wiring extending from said at least one light and said plurality of prongs.

3. The outlet mounted light fixture adapted to overlie and completely cover an existing wall outlet, as recited in claim 1, wherein said at least one light comprising:

a bulb for illuminating said selected areas.

4. The outlet mounted light fixture adapted to overlie and completely cover an existing wall outlet, as recited in claim 1, further comprising:

at least one electrical outlet mounted on said flat front panel for receiving electrical conductors and electrically connected to said plurality of prongs; and at least one side electrical outlet mounted on either side panel for receiving electrical conductors and electrically connected to said plurality of prongs.

5. The outlet mounted light fixture adapted to overlie and completely cover an existing wall outlet, as recited in claim 1, further comprising;

mounting means for securely mounting said outlet mounted light fixture to said existing wall outlet, and said mounting means providing support to said fixture.

6. The outlet mounted light fixture adapted to overlie and completely cover an existing wall outlet, as recited in claim 5, wherein said mounting means further comprising:

an elongated screw for extending from said flat front panel through said fixture and into said existing wall outlet, said elongated screw being removable.

7. An outlet mounted light fixture adapted to overlie and completely cover an existing wall outlet, comprising:

a flat front panel;

a flat back panel parallel to said flat front panel;

a plurality of prongs extending from said back panel for entering and electrically connecting to said existing wall outlet;

a top panel connected to said flat front panel and said flat back panel;

a bottom panel connected to said flat front panel and said flat back panel;

a right side panel and a left side panel, each said side panels connecting said top panel and said bottom panel;

at least one electrical outlet mounted on said flat front panel for receiving electrical conductors and electrically connected to said plurality of prongs;

at least one side electrical outlet mounted on either side panel for receiving electrical conductors and electrically connected to said plurality of prongs;

at least two lights electrically connected to said at least one electrical outlet and electrically connected to said plurality of prongs, for providing illumination to at least one selected area;

at least two stems for physically connecting each said at least two lights to said top panel and extending above said top panel for positioning each said at least two lights in said selected areas for illumination;

receptacle means positioned in each said at least one stem for electrically connecting said at least one outlet to each said at least two lights and to said plurality of prongs for electrically receiving power; and at least one of said at least two stems includes a bendable and flexible hollow structure for receiving electrical wiring, said wiring extending from each said at least two lights and at least one electrical outlet.

8. The outlet mounted light fixture adapted to overlie and completely cover an existing wall outlet, as recited in claim 7, wherein at least one of said at least two stems comprising:

a rigid hollow structure for receiving electrical wiring, said wiring extending from said at least one light means and at least one electrical outlet.

9. The outlet mounted light fixture adapted to overlie and completely cover an existing wall outlet, as recited in claim 7, wherein at least one of said at least two lights comprising:

a bulb for illuminating said selected areas.

10. The outlet mounted light fixture adapted to overlie and completely cover an existing wall outlet, as recited in claim 7, further comprising;

mounting means for securely mounting said outlet mounted light fixture to said existing wall outlet, and said mounting means providing support to said fixture.

11. The outlet mounted light fixture adapted to overlie and completely cover an existing wall outlet, as recited in claim 10, wherein said mounting means further comprising:

an elongated screw for extending from said flat front panel through said fixture and into said existing wall outlet, said elongated screw being removable.

12. An outlet mounted light fixture adapted to overlie and completely cover an existing wall outlet, comprising:

a flat front panel;

a flat back panel parallel to said flat front panel;

a plurality of prongs extending from said back panel for entering and electrically connecting to said existing wall outlet;

a top panel connected to said flat front panel and said flat back panel;

a bottom panel connected to said flat front panel and said flat back panel;

a right side panel and a left side panel, each said side panels connecting said top panel and said bottom panel;

at least one electrical outlet mounted on said flat front panel for receiving electrical conductors and electrically connected to said plurality of prongs;

at least one side electrical outlet mounted on either side panel for receiving electrical conductors and electrically connected to said plurality of prongs;

at least one light electrically connected to said at least one electrical outlet and electrically connected to said plurality of prongs, for providing illumination to a selected area;

at least one rigid stem for physically connecting said light to said top panel and extending above said top panel for positioning said light in said selected areas for illumination;

at least one flexible stem for physically connecting said light to said top panel and extending above said top panel for positioning said light in said selected areas for illumination;

mounting means for securely mounting said outlet mounted light fixture to said existing wall outlet, and said mounting means providing support to said fixture; and receptacle means positioned in said at least one stem for electrically connecting said at least one outlet to said at least one light and to said plurality of prongs for electrically receiving power.

13. The outlet mounted light fixture adapted to overlie and completely cover an existing wall outlet as recited in claim 12 further comprising:

at least one control switch for controlling the at least one light.

14. The outlet mounted light fixture adapted to overlie and completely cover an existing wall outlet, as recited in claim 1, wherein said at least one light comprising:

at least one control switch for controlling said at least one light.

15. The outlet mounted light fixture adapted to overlie and completely cover an existing wall outlet, as recited in claim 7, wherein at least one of said at least two lights comprising:

at least one control switch for controlling at least one of said two lights.

* * * * *